US008739999B2

(12) United States Patent
Kasboske

(10) Patent No.: US 8,739,999 B2
(45) Date of Patent: Jun. 3, 2014

(54) METHOD AND ASSEMBLY FOR ACCESSING THE CONTENTS OF A SEALED CONTAINER

(76) Inventor: George Kasboske, Hickory Hills, IL (US)

( * ) Notice: Subject to any disclaimer, the term of this patent is extended or adjusted under 35 U.S.C. 154(b) by 166 days.

(21) Appl. No.: 12/949,654

(22) Filed: Nov. 18, 2010

(65) Prior Publication Data

US 2011/0127266 A1 Jun. 2, 2011

Related U.S. Application Data

(60) Provisional application No. 61/272,939, filed on Nov. 19, 2009.

(51) Int. Cl.
*B65D 51/20* (2006.01)
*B65D 25/08* (2006.01)

(52) U.S. Cl.
USPC ..... 220/258.4; 220/258.3; 206/222

(58) Field of Classification Search
CPC ..... B65D 17/165; B65D 2251/0015; B65D 39/0011; B65D 39/12; B65D 39/02; B65D 39/16; B65D 5/748; B65D 5/749; B65D 7/36; B67B 7/24; B67B 7/28
USPC ..... 222/80–83, 541.1; 220/82, 80, 278, 220/277, 267, 258.3, 258.1; 215/297, 257, 215/223; 203/532, 222
See application file for complete search history.

(56) References Cited

U.S. PATENT DOCUMENTS

| | | | | | |
|---|---|---|---|---|---|
| 5,082,136 | A * | 1/1992 | Schumann | ..... | 220/278 |
| 5,255,813 | A * | 10/1993 | Berggren et al. | ..... | 220/278 |
| 5,366,114 | A * | 11/1994 | Bernstein et al. | ..... | 222/83 |
| 7,178,683 | B2 * | 2/2007 | Birkmayer et al. | ..... | 215/257 |
| 2009/0026165 | A1 * | 1/2009 | Ammann | ..... | 215/257 |

* cited by examiner

*Primary Examiner* — J. Gregory Pickett
*Assistant Examiner* — Kaushikkumar Desai
(74) *Attorney, Agent, or Firm* — Wood, Phillips, Katz, Clark & Mortimer

(57) ABSTRACT

A container has a body defining a compartment and a discharge opening. A material is provided within the compartment. A sealing assembly in a sealed state blocks communication of the material from the compartment to and through the discharge opening. A first assembly is provided for reconfiguring the sealing assembly to an operative state to establish a communication path from the compartment to and through the discharge opening. The first assembly has at least a first component that is movable guidingly relative to the body between: a) a storage position; and b) an operative position. The sealing assembly is changeable from the sealed state into the operative state as an incident of the at least first component moving from the storage position into the operative position without the at least first component fully separating from the body.

18 Claims, 11 Drawing Sheets

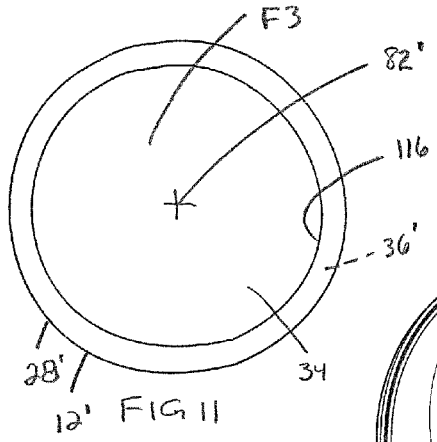
FIG 11
FIG. 10
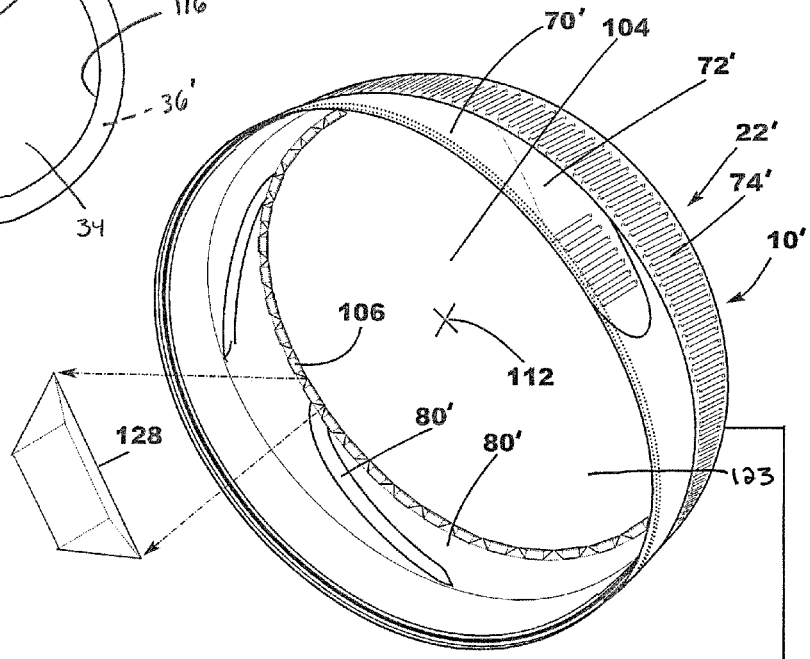
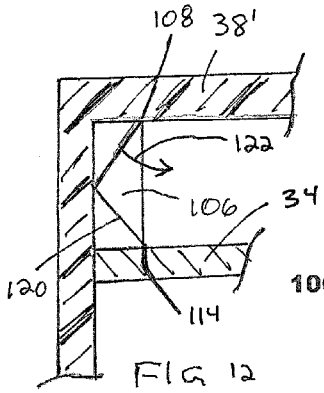
FIG 12
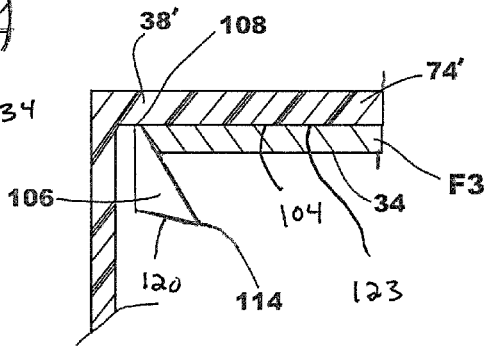
FIG. 13
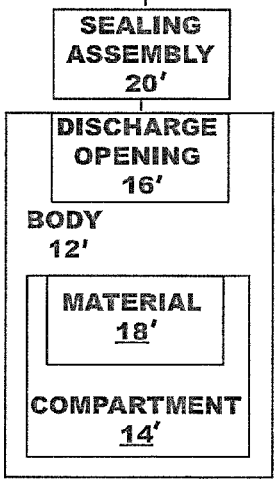

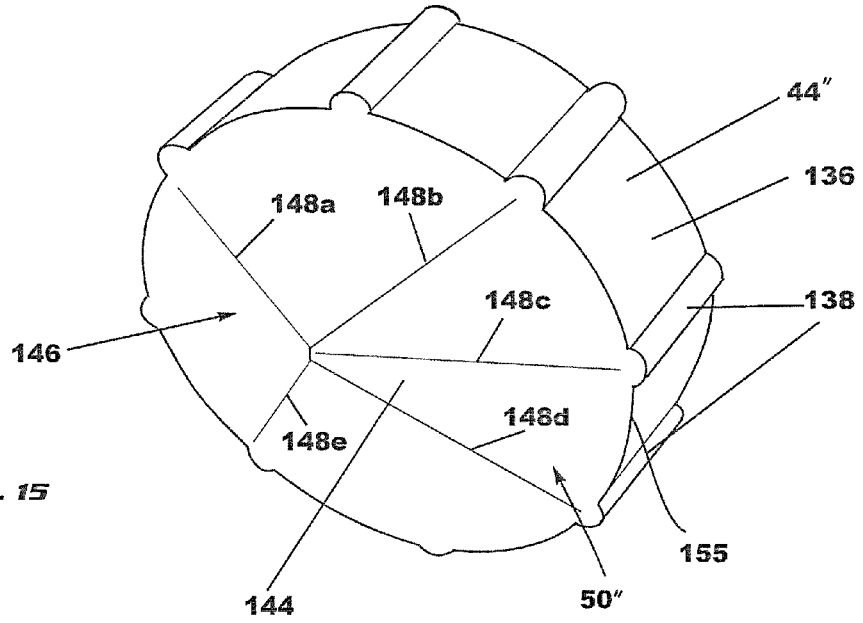
FIG. 15
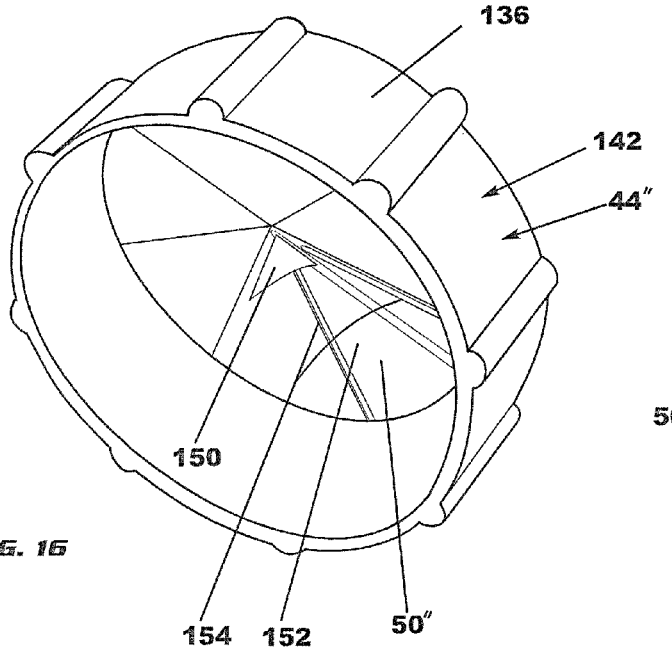
FIG. 16
FIG. 17
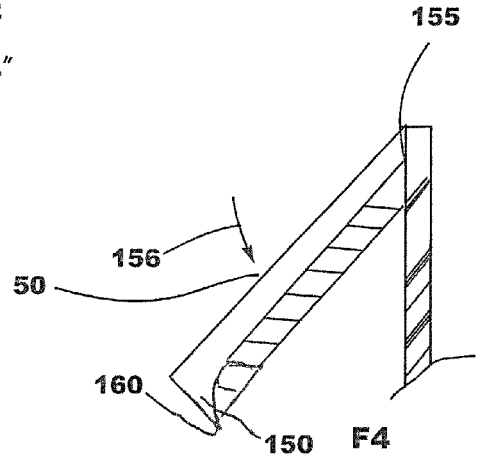
F4

METHOD AND ASSEMBLY FOR ACCESSING THE CONTENTS OF A SEALED CONTAINER

BACKGROUND OF THE INVENTION

1. Field of the Invention

This invention relates to containers in which the contents thereof is in a sealed compartment and, more particularly, to a method and assembly for accessing the contents.

2. Background Art

A multitude of products is offered to end users with the contents thereof in a sealed state within a compartment. This type of product ranges from those that are edible to those that are used by mechanics, construction workers, etc.

The contents of containers is maintained in a sealed state for many different reasons. Sealing of a container prevents escape of the contents from the compartment. Sealing of the contents may prevent contamination by environmental air and/or components entrained therein. Sealing of containers may also at least slow reaction of the contents with the atmospheric air, be it curing, evaporation, or other change in state that renders the contents less desirable than it is in its originally manufactured state. The sealing may also be for the purpose of simply avoiding any effusion of odor from the contents of the container. Regardless of the purpose of the sealing, and keeping in mind that the above described purposes are not exhaustive, once the contents of the container is required to be accessed, the end user must take steps to reconfigure, by rupturing or removal, any sealing layer(s).

In a typical sealing assembly, a sealing layer will be provided at the mouth of a container from which the contents is dispensed. Often, a cap is provided at this mouth location and is removed preparatory to rupturing or removing the sealing layer. In one exemplary form, a cap is threaded onto a container to block the mouth opening. The user removes the cap and thereafter either removes or ruptures the sealing layer to expose the container contents, after which the cap is replaced and the contents controllably dispensed through the cap. In many constructions, the cap has an integrally formed tab that must be removed before the cap can be separated. This construction positively secures the cap in place and also provides a means for visually identifying that the container has been tampered with, whereby its contents may have been accessed.

While the aforementioned sealing assembly is common and generally functional, it has a number of drawbacks. First of all, this type of sealing assembly has some inconvenience associated with it. The end user is required to serially perform the steps of removing the cap, altering the sealing layer, and replacing the cap. Aside from the fact that multiple steps must be performed, the step of removing or rupturing a sealing layer may be difficult or awkward. This is particularly true with sealing layers that are closely conformed to, wrapped against, and/or adhered to, surfaces around mouth openings.

If a user wishes to remove the sealing layer, he/she may have to search to find, or create, an edge thereon that may be pulled to initiate separation. Even if tabs are provided for this purpose, the tabs are purposely made small such that they are difficult to manipulate. As a result, the user may be required to resort to the use of a sharp instrument to separate an edge that might be pulled.

If the end user wishes to simply rupture the sealing layer, he/she will typically use a finger or tool to pierce the layer by advancing the finger/tool into the compartment where the contents is located. This exercise may contaminate the contents or cause an undesirable reconfiguration thereof, as in the event that the contents is prone to being ruptured or fractured.

Penetration of the container by a user's finger may also expose the user to the contents. Often the contents is caustic or aggressively adherent, thereby necessitating that steps be taken to remove the same from the user's finger(s).

Another problem that has persisted is that with certain types of containers, the process of accessing the contents may undesirably reconfigure the container for dispensing. As an example, products sold in containers that cause discharge of contents using caulking guns experience these problems. Typically, the product will be contained in a cylindrical tube with a plunger that can be advanced by the caulking gun towards a discharge end. At the discharge end, a tubular dispensing tip is provided that has a tapering configuration towards a distal end. The sealing layer resides potentially several inches from the distal end, as a result of which part of the distal end of the tip must be removed to allow the introduction of an elongate component that can be used to penetrate the sealing layer to define an egress path.

While ideally the tip is designed to be cut at its distal end so that potentially a very small diameter opening is created to allow discharge of a thin stream of the contents, often the end user will not have a component of a like, small diameter with a length sufficient that it can be directed through the opening to penetrate the sealing layer. As a result, users will typically make the opening larger than desired to accommodate available components that are used to penetrate the sealing layer.

It is conservative to say that hundreds, if not thousands, of products are offered in numerous diverse fields that contend with the above problems. Notwithstanding this, it is not known of any existing commercial sealing assemblies that allow consumers to use products on a daily basis without contending with the inconveniences noted above. The need for better ways to access the contents of sealed containers exists to this day.

SUMMARY OF THE INVENTION

In one form, the invention is directed to a container with a body having a compartment and a discharge opening and material within the compartment. A sealing assembly has a sealed state wherein the sealing assembly blocks communication of the material from the compartment to and through the discharge opening. A first assembly is provided for reconfiguring the sealing assembly to an operative state to establish a communication path from the compartment to and through the discharge opening. The first assembly has at least a first component that is movable guidingly relative to the body between a storage position and an operative position. The sealing assembly is changeable from the sealed state into the operative state as an incident of the at least first component moving from the storage position into the operative position without requiring the at least first component to be fully separated from the body.

In one form, the sealing assembly is a sealing layer and the first assembly is a discrete component that is caused to penetrate the sealing layer as the first component is changed from the storage position into the operative position.

In one form, the first component is threadably engaged with the body and is turned around an axis relative to the body to be changed between the storage and operative positions.

In one form, the first component has a through passage and an outlet end and with the first assembly in the operative state and the first component in the operative position, a communication path is defined for the material in the compartment to and through the discharge opening and to and through the through passage to and from the outlet end.

In one form, with the first assembly in the operative state, the first component is positionable relative to the body to block communication of material from the compartment to and through the discharge opening.

In one form, as the first component is moved relative to the body between the storage and operative positions, the first component causes the material within the compartment to cause the sealing assembly to change from the sealed state into the operative state.

In one form, the first component is movable relative to the body into a closed position to thereby block communication of material from the compartment to and through the discharge opening. The first component has a first set of threads that cooperates with a second set of threads on the container so that the first component can be turned around an axis relative to the body, as an incident of which the first component is changed between the operative and closed positions.

In one form, the container further has a holding assembly for maintaining the first component in the storage position.

In one form, the holding assembly has at least one element that is reconfigurable to change the holding assembly between a holding state and a release state. The holding assembly allows the first component to be changed from the storage position into the operative position with the holding assembly in the release state.

In one form, the at least one element is connected to a wall on the first component and is torn away from the wall on the first component to change the holding assembly from the holding state into the release state.

In one form, the first assembly has a first blade that is repositioned relative to the body as the first component is moved from the storage position into the operative position.

In one form, the first assembly has first and second blades that are movable relative to the body as the first component is moved from the storage position into the operative position.

In one form, the first blade is on an arm that pivots relative to the body as the first component is moved from the storage position into the operative position.

In one form, the first assembly includes a plurality of discrete components with blades that are bent relative to the body as the first component is moved from the storage position into the operative position.

In one form, the sealing assembly includes a sealing layer and the first assembly consists of a blade on an arm. The blade and arm are caused to penetrate the sealing layer as the first component is changed from the storage position into the operative position to form a discrete flap in the sealing layer.

In one form, the sealing assembly includes a first body that spans across the discharge opening.

In one form, the first component is a plunger that causes the material to move the discrete component so that the discrete component penetrates the sealing layer as an incident of the plunger moving from the storage position into the operative position.

In one form, the first assembly includes a first body having a cup-shaped configuration.

In one form, there is structure that cooperates between the body and first component that prevents separation of the first component from the body.

In one form, the sealing assembly includes a sealing layer and the first component is configured to sever a part of the sealing layer and releasably maintain the part of the sealing layer on the first component as an incident of the first component moving from the storage position into the operative position.

In one form, the invention is further directed to a method of accessing a stored material. The method includes the steps of: a) providing a container as described above; b) with the sealing assembly in the sealed state, moving the first component from its storage position into its operative position and thereby changing the sealing assembly into the operative state; and c) with the sealing assembly in the operative state, causing material to be communicated from the compartment to and through the discharge opening.

BRIEF DESCRIPTION OF THE DRAWINGS

FIG. 10 is a partially schematic representation of a modified form of container, according to the present invention and as shown in FIG. 1, and with a modified form of first assembly and first component thereon;

FIG. 11 is a reduced, fragmentary, plan view of a sealing layer covering a discharge opening on the body in which the material is stored;

FIG. 12 is a fragmentary, cross-sectional view of a part of the first assembly and showing a relationship between cutting blades thereon and a sealing layer with the first component in a storage position;

FIG. 13 is a view as in FIG. 12 wherein the first component has been moved from the storage position in FIG. 12 into an operative position to change the sealing assembly into its operative state;

FIG. 15 is an enlarged, top, perspective view of the body on the first assembly in FIG. 14;

FIG. 16 is an enlarged, bottom, perspective view of the body in FIG. 15;

FIG. 17 is an enlarged, fragmentary, cross-sectional view showing a discrete component with a cutting blade on the body in FIGS. 14-16 reconfigured to penetrate the sealing layer.

Figure 1:
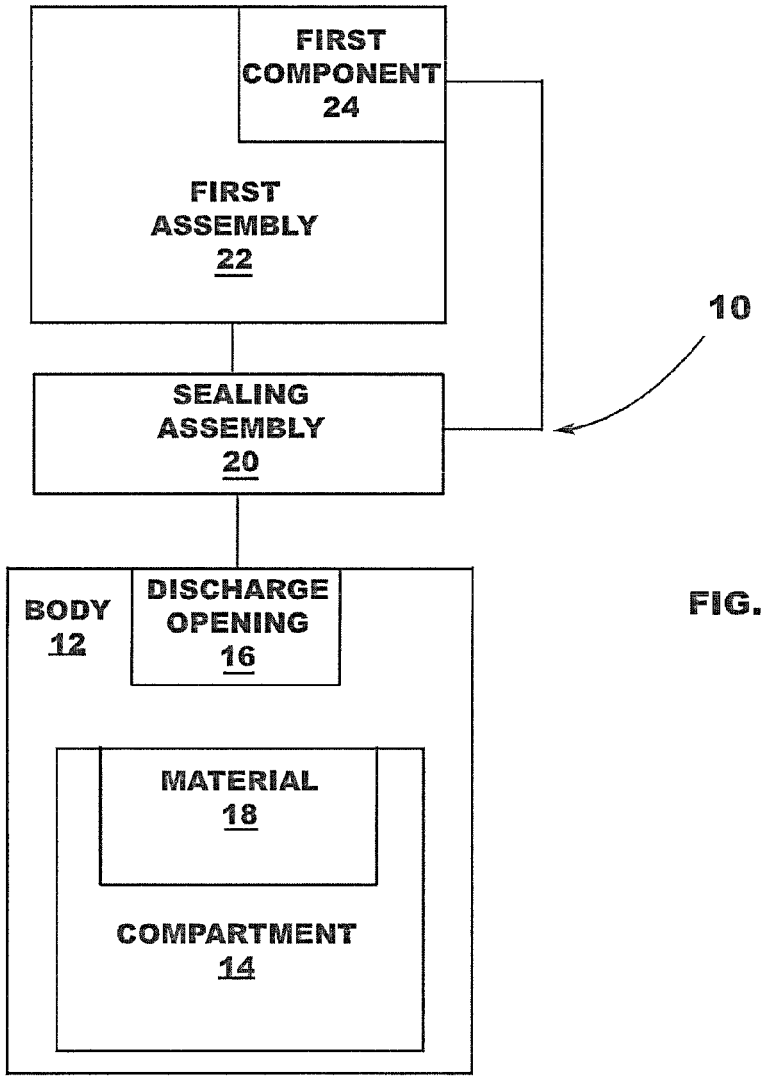
FIG. 1 is a schematic representation of a container, according to the present invention, for discharging material through a discharge opening on a body defining a compartment for the material and including a sealing assembly for the discharge opening and a first assembly for reconfiguring the sealing assembly.

DETAILED DESCRIPTION OF THE PREFERRED EMBODIMENT in FIG. 1, a container, according to the present invention, is shown at 10. The container 10 has a body 12 that defines a compartment 14 and a discharge opening 16. Material 18 is provided in the compartment 14 and has a flowable nature to allow it to be controllably discharged through the opening 16. The nature of the material 18 is not critical to the present invention, as it may range from edible material to material used in heavy industry. As noted above, the only significant characteristic of the material 18 is that it be of a type that can be dispensed at the opening 16 by flowing therethrough. This discharge may be the result of simple gravitational pouring. Alternatively, the material 18 might be forced from the compartment 14 and through the discharge opening 16 as through a squeezing action upon the body 12 and/or through the use of a tool with a movable plunger.

A sealing assembly 20 is provided at the discharge opening 16 and has a sealed state, wherein the sealing assembly 20 blocks communication of the material 18 from the compartment 14 to and through the discharge opening 16. A first assembly 22 is provided to reconfigure the sealing assembly 20 to an operative state to establish a communication path from the compartment 14 to and through the discharge opening 16.

The first assembly 22 has at least a first component 24 that is movable guidingly relative to the body 12 between: a) a storage position; and b) an operative position. The sealing assembly 20 is changeable from the sealed state into the operative state as an incident of the first component 24 moving from the storage position into the operative position without requiring the at least first component 24 to be fully separated from the body 12.

The container 10 is shown in schematic form since it is intended through this showing to encompass not only the specific embodiments described hereinbelow, but those incorporating changes in one or more of the elements depicted in FIG. 1. Such modifications would be obvious to one skilled in the art with the inventive concepts in hand.

One specific form of container, as shown in FIG. 1, is shown in FIGS. 2-9. The container 10 has the aforementioned body 12 with accordion folds 26 at opposite sides which facilitate squeezing thereof. The body 12 bounds the compartment 14 within which the particular material 18 is contained. The body 12 is squeezed to force material 18 from the compartment 14 to and through the discharge opening 16. The discharge opening 16 is formed through a neck 28 that has an external surface 30 with a set of threads 32 thereon.

Figure 3:
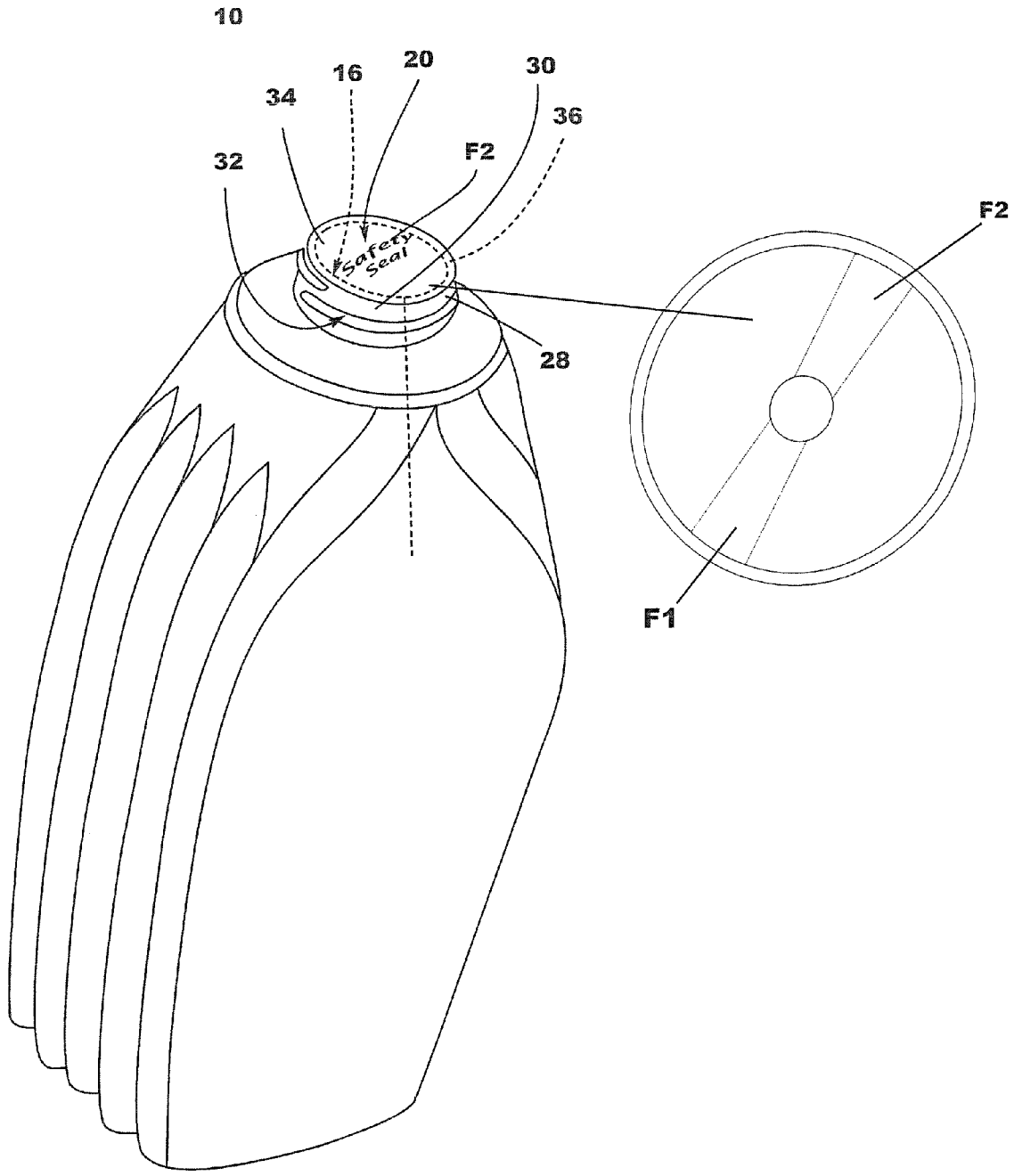
FIG. 3 is a view as in FIG. 2 wherein the first component is removed to expose the sealing assembly.
Figure 4:
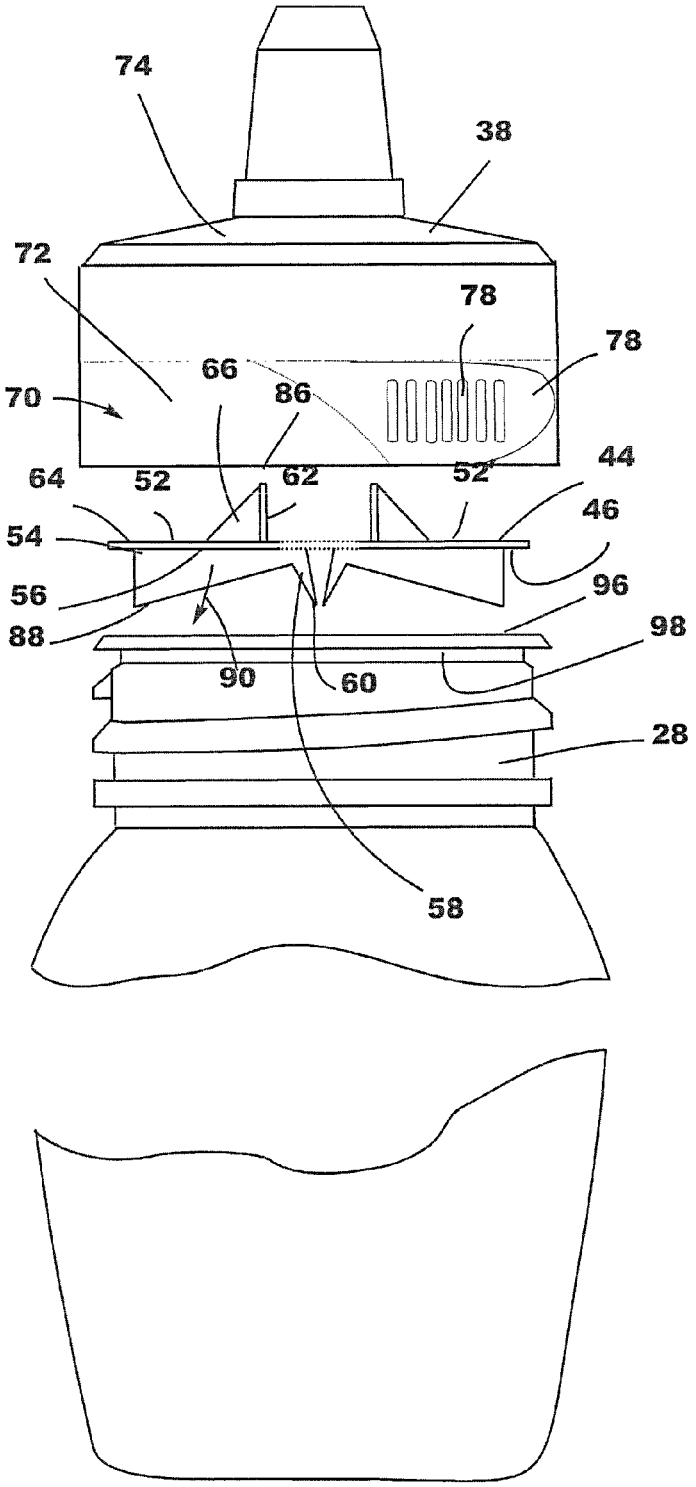
FIG. 4 is an enlarged, exploded, fragmentary, elevation view of the container in FIG. 2.

The sealing assembly 20 consists of a sealing layer 34 that is attached over an upper edge 36 of the neck 28 with the sealing assembly 20 in the sealing state, as shown in FIG. 3. The sealing layer 34 might be adhesively bonded or otherwise attached to the neck 28 so as to span the discharge opening 16 and thereby block communication of the material 18 from the compartment 14 to and through the discharge opening 16 with the sealing assembly 34 in the sealed state.

The first assembly 22 consists of a first component 38 in the form of a closure cap. The first component 38 has an opening 40 at an outlet end 41 through which material 18 communicated through the discharge opening 16 can be controllably directed to a point of use. A conventional shutoff assembly 42 can be incorporated to be manipulated by a user to selectively block and expose the opening 40.

Figure 2:
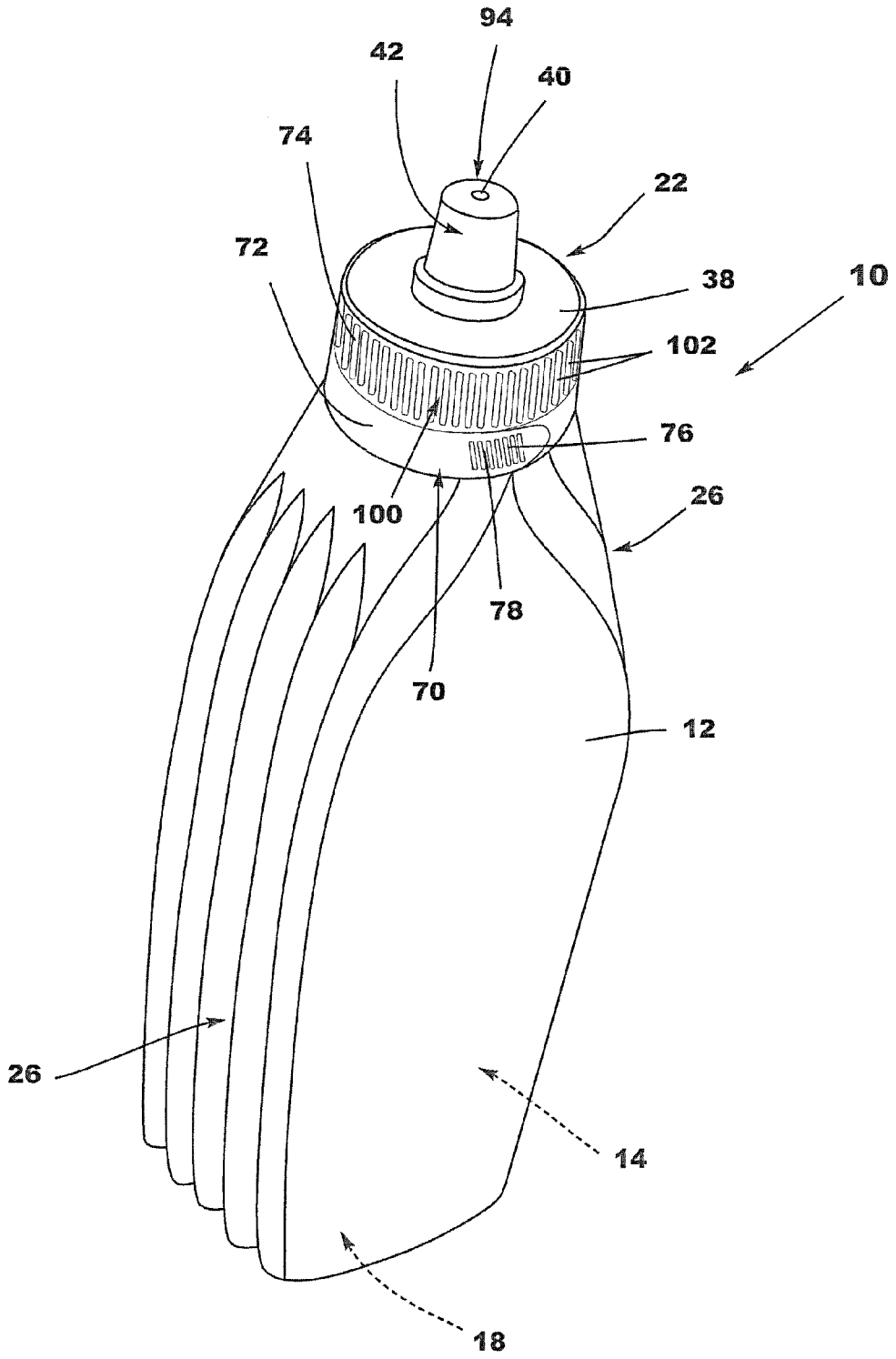
FIG. 2 is a perspective view of one form of container, as shown in FIG. 1, with a first component on the first assembly in a storage position.
Figure 5:
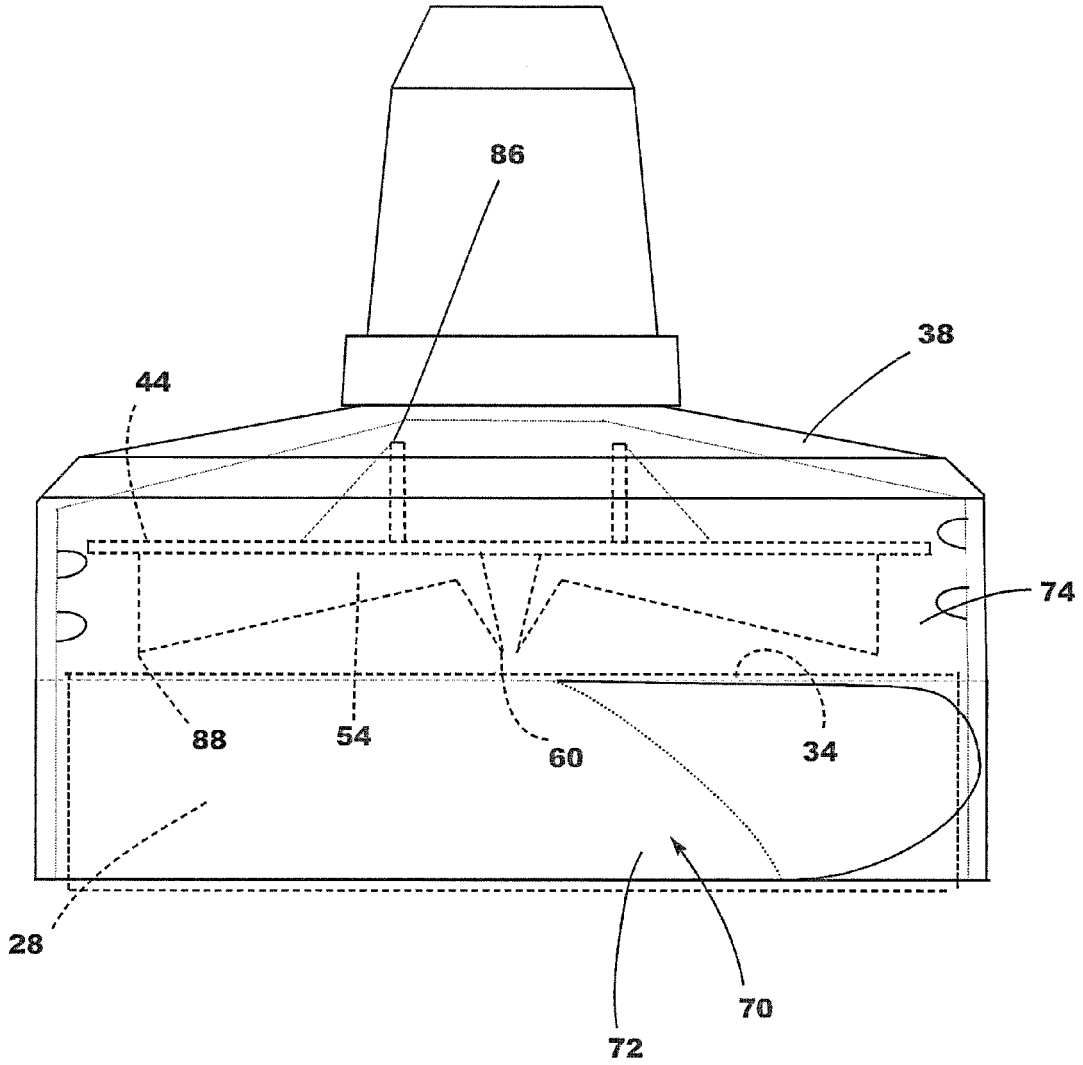
FIG. 5 is an enlarged, fragmentary, elevation view of the container in FIG. 2 and showing in dotted lines the relationship between the first assembly and the sealing assembly with the first assembly in a sealed state and the first component on the first assembly in the storage position.
Figure 6:
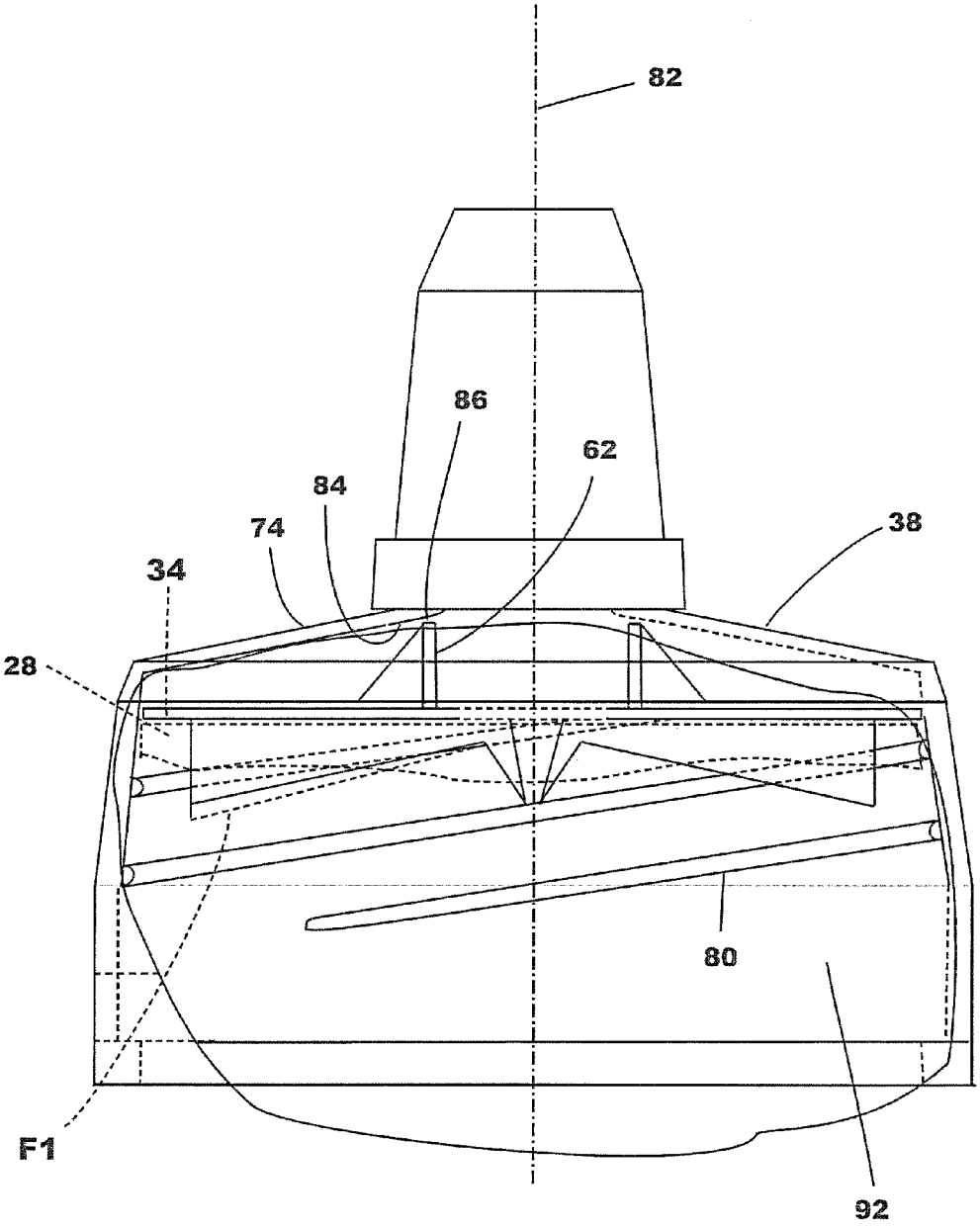
FIG. 6 is a view corresponding to that in FIG. 5 wherein the body is broken away to expose the first assembly and showing in dotted lines the relationship the first assembly and the sealing assembly would have with the first component on the first assembly in an operative position and the sealing assembly in an operative state.
Figure 7:
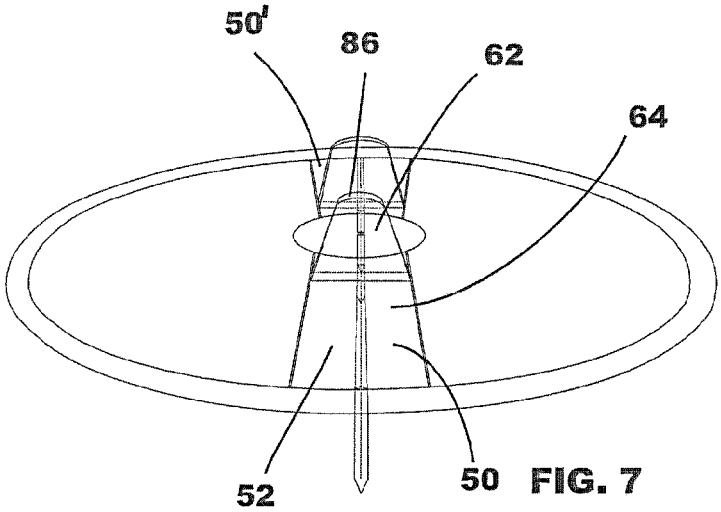
FIG. 7 is an enlarged, top, perspective view of a part of the first assembly.
Figure 8:
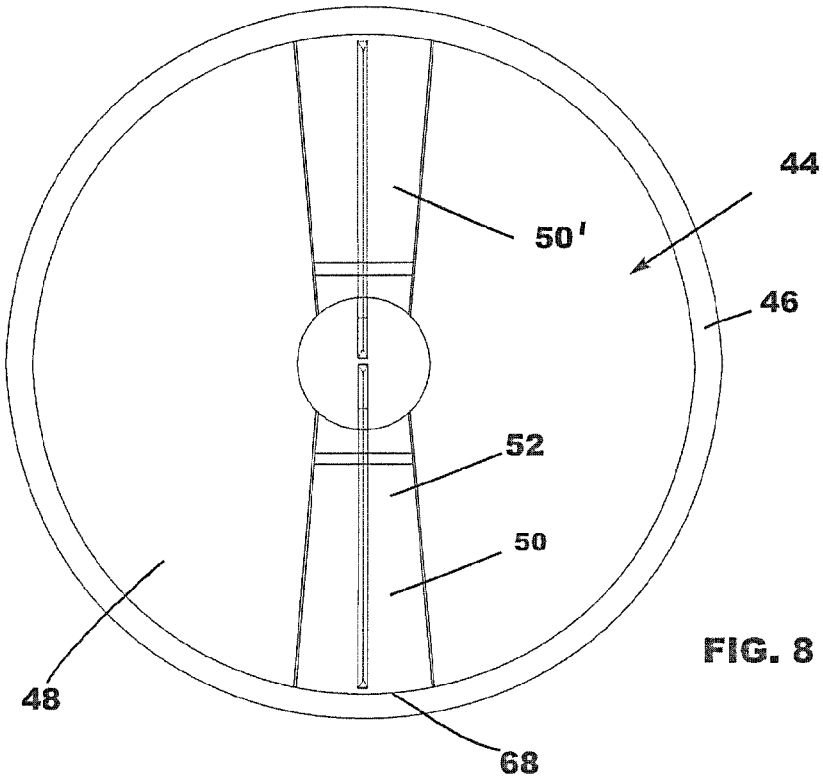
FIG. 8 is an enlarged, plan view of the part of the first assembly in FIG. 7.
Figure 9:
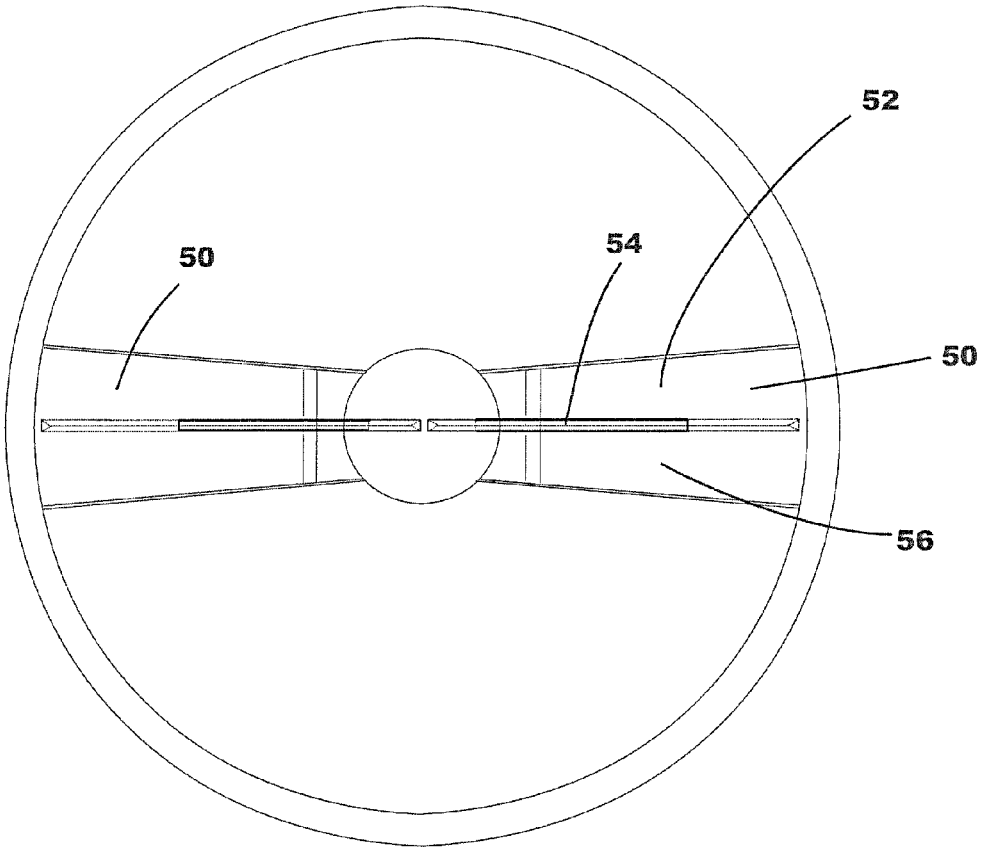
FIG. 9 is an enlarged, bottom view of the part of the first assembly in FIGS. 7 and 8.

The first assembly 22 further is made up of a body 44, that is separate from the body 12 and cooperates between the first component 38 and body 12 to cause the sealing assembly 20 to be changed from its sealed state into its operative state as an incident of the first component 38 moving guidingly relative to the body 12 between a storage position, as shown in FIGS. 2 and 5, and an operative position, as shown in FIG. 6.

The body 44 consists of an annular rim 46 that matches at least nominally to the dimension of the upper edge 36 to bear thereagainst with the sealing layer 34 therebetween. Within the rim 46 are a web 48 and separate discrete components 50, 50', of like construction. It should be understood that potentially only a single discrete component is required for the inventive structure to operate. Only exemplary discrete component 50 will be described herein, with it being understood that the discrete component 50' is constructed and operates in the same manner.

The discrete component 50 consists of a radially extending, flat arm 52 with a flat blade 54 projecting axially from the underside 56 of the arm 52. The blade 54 has a tapered projection 58 with a distal, sharpened apex 60.

An actuating wall 62 projects axially upwardly from the upper side 64 of the arm 52 and is stabilized by a reinforcing wall 66.

The arm 50 is cantilever mounted through its radially outermost edge 68.

With the sealing assembly 20 in its sealed state and the first component 38 in its storage position, as shown in FIG. 5, the blade 54 resides slightly above the sealing layer 34.

The first component 38 is maintained in the storage position by a holding assembly 70. The holding assembly 70 consists of at least one element 72 that is connected to, and preferably integrally formed with, a wall 74 on the first component 38. This type of holding assembly 70 is common to many commercially available containers used for a variety of different materials. With the element 72 intact, the holding assembly 70 is in a holding state, which, as noted above, causes the holding assembly 70 to maintain the first component 38 in its storage position.

By grasping a projecting tab 76 with a knurled surface 78 on the element 72, the element 72 can be torn away from the wall 74 of the first component 38, thereby changing the holding assembly 70 from its holding state into a release state. With the holding assembly 70 in its release state, the first component 38 can be changed back and forth between its storage and operative positions.

The first component 38 has a set of threads 80 that cooperate with the aforementioned set of threads 32 on the neck 28 in a manner whereby turning of the first component 38 relative to the body 12 around an axis 82 causes the first component 38 to move axially relative to the body 12 and thereby change between the storage and operative positions.

With the holding assembly 70 in the release state, the sealing assembly 20 in the sealed state, and the first component 38 in the storage position, turning of the first component 38 around the axis 82 relative to the body 12 causes the first component 38 to advance to the operative position. As this occurs, an inside surface 84 on the wall 74 of the first component 38 bears against an upper edge 86 on the wall 62, thereby initially axially driving the apex 60 of the blade 54 and a spaced portion 88 of the blade 54 against the sealing layer 34 so as to fully penetrate the same, as seen in FIG. 5. Once the rim 46 on the body 44 abuts and becomes braced against the upper edge 36 of the neck 28, with a portion of the sealing layer 34 therebetween, continued downward movement of the first component 38 causes the arm 52 to bend in the direction of the arrow 90 in FIG. 4. Once the first component 38 has been advanced fully to its operative position, the deflected arm 52 will cut away at least one flap F1 to thereby form an opening through the sealing layer 34 corresponding in shape to that of the arm 50. Through this opening, the material 18 will be allowed to flow. The arm 52' produces at least one other like flap F2.

The material 18 is thus permitted to flow through the sealing layer 34 and guidingly through a passage 92 defined by the first component 38. A communication path is thus defined for the material 18 in the compartment 14 to and through the discharge opening 16, to and through the passage 92, and to and through the opening 40 at the outlet end 41 of the first component 38 via the shutoff assembly 42, when in an open state.

Another feature of the invention is the provision of a holding ring 96 on the neck 28. The holding ring 96 defines an axially facing shoulder 98. With the first component 38 in its storage position, the threads 80 abut the shoulder 98, thereby arresting further turning of the first component 38 that would allow it to be fully separated from the body 12. This construction may require that the first component 38 initially be snap fit in place to thereby force the threads 80 axially past the holding ring 96.

With this feature, the first component 38 remains at all times connected to the body 12 as the sealing assembly 20 is changed from its sealed state into its operative state and the container 10 is thereafter utilized to dispense the material 18.

To facilitate turning of the first component 38, the peripheral outer surface at 100 has a knurled configuration to facilitate gripping thereof. The knurled configuration is produced by a plurality of regularly spaced, elongate, projections 102.

In FIGS. 10-13, a modified form of container is shown at 10'. The container 10' consists of a body 12', as previously described with a compartment 14' with a supply of material 18' therein, which is capable of being dispensed through a discharge opening 16'. The container 10' has the associated sealing assembly 20, as previously described.

The container 10' differs from the container 10 primarily in the configuration of the first assembly 22', corresponding to the first assembly 22 described above. The first assembly 22' has a corresponding first component/closure cap 38' with a cup-shaped wall structure 103 with internal threads 80' thereon.

Rather than defining a flow passage as the first component 38 does, the first component 38' has a blocking wall 104 that is part of the wall structure 103 and can be used to block communication of material 18' from the compartment 14' to and through the discharge opening 16'.

The first assembly 22' has a holding assembly 70' with an element 72' that cooperates with a wall 74' on the first component 38' in the same manner that the element 72 cooperates with the wall 74 on the holding assembly 70, as previously described.

The first component 38' is movable guidingly relative to the body 12' between corresponding storage and operative positions, as described for the first component 38.

A plurality of discrete components/blades 106 are integrally formed with the wall 74' and are each joined thereto along an edge 108 at which the discrete components/blades 106 are locally thinned, where the discrete components/blades 106 connect to the wall structure 103, so that the discrete components/blades 106 controllably bend at the defined edges 108. The blades 106 are connected at regular intervals fully around the central axis 112 of the first component 38', that coincides with the axis 82' for the body 12'.

The first component 38' is placed initially in its storage position, as shown in FIG. 12, wherein elongate cutting edges 114 on the components/blades 106 are spaced slightly from the sealing layer 34 in its sealed state.

With the holding assembly 70' changed from its holding state into its release state by reconfiguring the element 72', the first component 38' can thereafter be turned to change the same from its storage position in FIG. 12 to its operative position in FIG. 13. As this occurs, the cutting edges 114 on the components/blades 106 penetrate the sealing layer 34. Turning of the first component 38 causes the blades 106 to produce a continuous cut 116 that severs a flap F3 from the sealing layer 34.

At the same time, cam edges 120 on the blades 106 bear against the upper edge 36' of the neck 28', with the sealing layer 34 therebetween, and are bent progressively around their edges 108 relative to the wall structure 103 in the direction of the arrow 122 in FIG. 12. With the first component 38' in the operative position of FIG. 13, the components/blades 106, by reason of bending, collectively capture the flap F3 against the blocking wall 104 at a wall surface 123 so that the flap F3 will follow movement of the first component 38, as it is moved to be fully separated from the body 12'. The blades 106 change from their FIG. 12 position to their FIG. 13 position by bending around the edges 108 and without any significant deformation of the lengths of the blades between the edges 108 and free ends at which the cutting edges 114 are formed.

The body 12' differs from the body 12 primarily by reason of not having a structure corresponding to the holding ring 96, whereby the first component 38 can be readily fully separated from the body 12' to expose the discharge opening 16'.

With the container 10', the first component 38' can be moved from its storage position into its operative position and thereafter placed in a closed position so that the wall surface 123 with the captive flap F3 blocks communication of material 18' from the compartment 14' to and through the discharge opening 16'. The closed position may actually be the same as the operative position or may be a different position for the first component 38'.

In FIGS. 14-17, a further modified form of container is shown at 10". The container 10" consists of a body 12" defining a compartment 14" with a discharge opening 16" through which material 18" in the compartment 14" is dispensed.

In this embodiment, the body 12" has the configuration of a conventional tube that caulking, or other like material, is stored in and dispensed from. The body 12" is placed in a receptacle in a tool 124 having a drive component 126 that is extendable to advance a first component/plunger 38" in the direction of the arrow 130 towards the discharge opening 16".

A discharge tip/nozzle 132 is provided to direct material 18" controllably from the discharge opening 16" to a desired point of use. The tip/nozzle 132 has a hollow construction and a tapered discharge end 134. By selectively removing a portion of the discharge end 134, a variable size discharge opening can be formed, with one exemplary opening O identified resulting by cutting the end 134 along the line L.

A sealing layer 34" blocks the discharge opening 16".

In this embodiment, the first assembly 22" consists of the plunger/first component 38" and a body 44". The body 44" has a cup-shaped configuration with a peripheral wall 136 having outer, circumferentially spaced ribs 138 thereon spaced at regular intervals. The ribs 138 bear against a radially inwardly facing surface 140 bounding the container compartment 14". Spaces 142 are defined between adjacent ribs 138 to allow passage of air as the body 44" is initially directed into the compartment 14" to the operative position shown in FIG. 14. The spaces 142 prevent a pressure buildup that would resist movement of the body 44" to the FIG. 14 position, preparatory to placing the supply of material 18" into the compartment 14".

The first component/plunger 38" is in a storage position before it is advanced by the drive component 126 on the tool 124. Once moved by the drive component 126, the plunger 38" moves into an operative position. In the operative position therefor, the first component/plunger 38" has compressed the material 18" to a state wherein a force is exerted by the material 18" upon an axially facing surface 144 on a wall 146 on the body 44" that causes the wall 146 to be reconfigured.

The wall 146 has a series of serrated lines 148*a*, 148*b*, 148*c*, 148*d*, 148*e* that weaken the wall 146. Between the serrated lines 148*c*, 148*d*, a discrete component 50" is defined with a cutting blade 150 thereon. The underside 152 of the discrete component 50" has reinforcing ribs 154 thereon.

Figure 14:
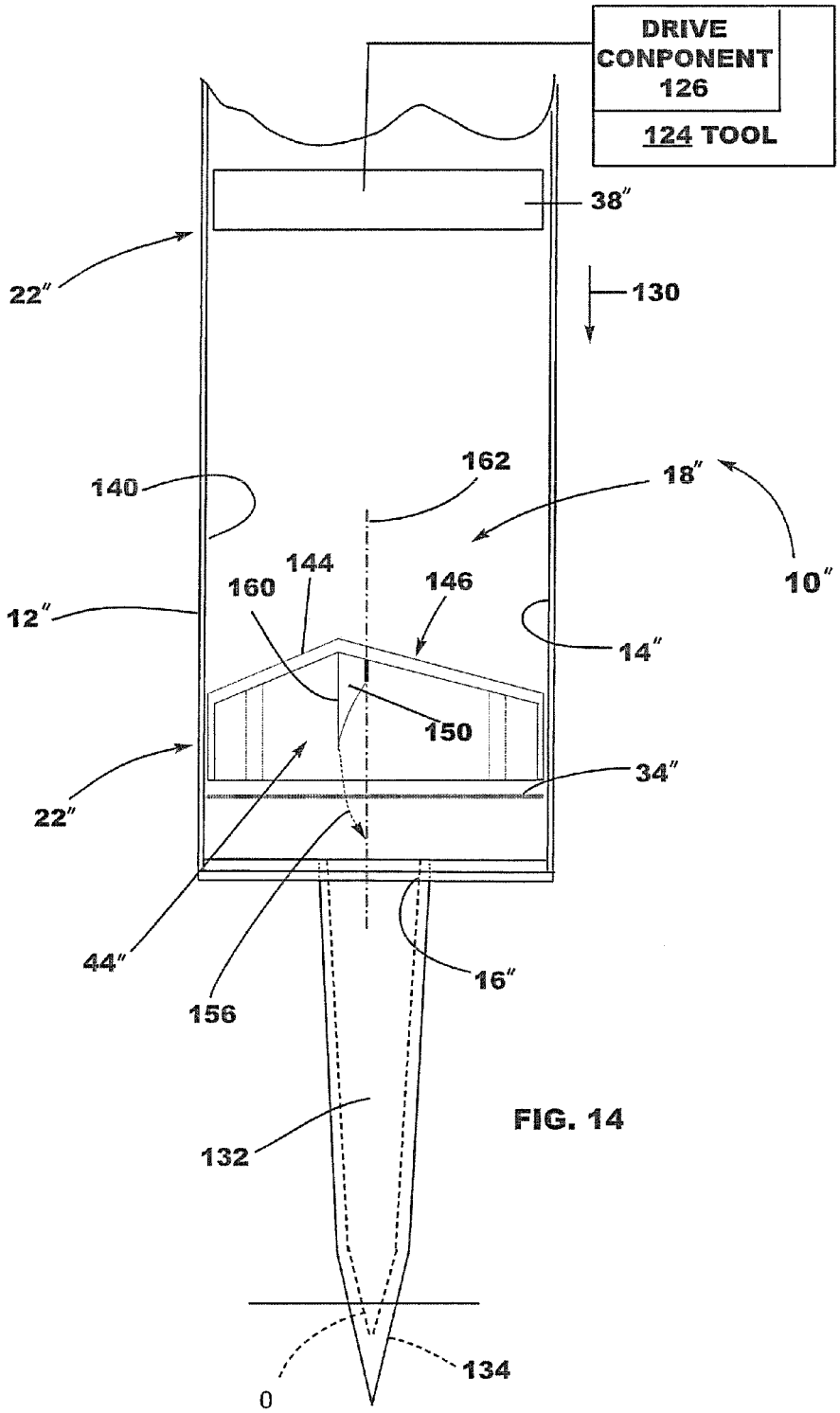
FIG. 14 is a fragmentary, partial cross-sectional view of a further modified form of container, according to the present invention and as shown in FIG. 1, which container cooperates with a tool to dispense material and having a first assembly consisting of a first component/plunger and a separate body placed adjacent to a discharge opening.

Under the force of the compacted material 18", the discrete component 50" will separate and pivot at an edge 155 in the direction of the arrow 156, whereupon the cutting blade 150 penetrates the sealing layer 34". Progressive pivoting of the discrete component 50" separates a flap F4 that produces an opening through the sealing layer 34", whereupon the material 18" can be delivered through the tip/nozzle 132 and thereafter the defined opening O at the end 134. As seen in FIG. 14, the leading edge 160 of the cutting blade 150 is extended beyond the central axis 162 of the body 12" so that the flap 158 has an extended radial extent to produce an adequate size opening to allow for the required volume of material passage.

Figure 18:
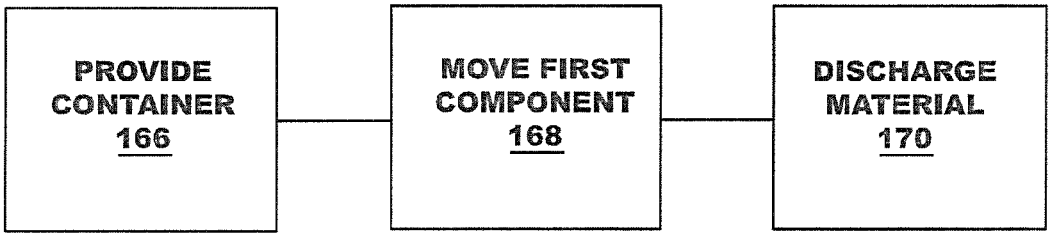
FIG. 18 is a flow diagram representation of one method of accessing stored material using the inventive container.

With the different containers, the stored material can be accessed by carrying out a method as shown in flow diagram form in FIG. 18.

As shown at block 166, a container is provided.

As shown at block 168, with the sealing assembly in the sealed state, the first component is moved from its storage position into its operative position, thereby changing the sealing assembly into the operative state.

As shown at block 170, with the sealing assembly in the operative state, material is caused to be communicated from the compartment to and through the discharge opening.

The foregoing disclosure of specific embodiments is intended to be illustrative of the broad concepts comprehended by the invention.

The invention claimed is:

1. A container comprising:

a body defining a compartment and a discharge opening;

material within the compartment;

a sealing assembly that has a sealed state wherein the sealing assembly blocks communication of the material from the compartment to and through the discharge opening; and a first assembly for reconfiguring the sealing assembly to an operative state to establish a communication path from the compartment to and through the discharge opening, the first assembly comprising at least a first component with a wall structure, the first component is movable guidingly relative to the body between: a) a storage position; and b) an operative position, the sealing assembly changeable from the sealed state into the operative state as an incident of the at least first component moving from the storage position into the operative position without the at least first component fully separating from the body, wherein the first assembly comprises a discrete component comprising a discrete blade that is moved relative to the wall structure consistently about a defined edge as the first component is moved from the storage position into the operative position, the discrete component having a length between the defined edge and a free end, the discrete component configured so that the discrete component does not significantly deform between the defined edge and free end as an incident of the first component moving from the storage position into the operative position.

2. The container according to claim 1 wherein the sealing assembly comprises a sealing layer and the discrete component is caused to penetrate the sealing layer as the first component is changed from the storage position into the operative position to thereby produce a flap out of the sealing layer.

3. The container according to claim 2 wherein the first component is threadably engaged with the body and is turned around an axis relative to the body to be changed between the storage and operative positions.

4. The container according to claim 1 wherein with the first assembly in the operative state, the first component is positionable relative to the body to block communication of material from the compartment to and through the discharge opening.

5. The container according to claim 4 wherein the first component is movable relative to the body into a closed position to thereby block communication of material from the compartment to and through the discharge opening, and the first component has a first set of threads that cooperates with a second set of threads on the container so that the first component can be turned around an axis relative to the body as an incident of which the first component is changed between the operative and closed positions.

6. The container according to claim 1 wherein the container further comprises a holding assembly for maintaining the first component in the storage position.

7. The container according to claim 6 wherein the holding assembly comprises at least one element that is reconfigurable to change the holding assembly between a holding state and a release state, the holding assembly allowing the first component to be changed from the storage position into the operative position with the holding assembly in the release state.

8. The container according to claim 7 wherein the at least one element is connected to a wall on the first component and is torn away from the wall on the first component to change the holding assembly from the holding state into the release state.

9. The container according to claim 3 wherein the discrete blade is a first blade with a first cutting edge and the first blade is bent so that the first cutting edge is moved towards the axis as the first component is moved from the storage position into the operative position.

10. The container according to claim 9 wherein the first assembly comprises a plurality of blades each with cutting edges and the plurality of blades is bent so that the cutting edges on the plurality of blades are each movable towards the axis as the first component is moved from the storage position into the operative position.

11. The container according to claim 2 wherein the first assembly comprises a plurality of discrete components comprising blades that are bent relative to the body as the first component is moved from the storage position into the operative position, the plurality of blades, by reason of bending, collectively capturing the flap against a part of the wall structure.

12. The container according to claim 1 wherein the sealing assembly comprises a first body that spans across the discharge opening.

13. The container according to claim 1 wherein the sealing assembly comprises a sealing layer and the first component is configured to sever a part of the sealing layer and releasably maintain the part of the sealing layer on the first component as an incident of the first component moving from the storage position into the operative position.

14. The container according to claim 1 wherein the discrete blade is joined to the wall structure at a locally thinned portion at which the defined edge is formed and at which the discrete blade bends in a controlled manner as an incident of the first component moving from the storage position into the operative position.

15. The container according to claim 3 wherein the first cutting edge is elongate at the free end.

16. A container comprising:

a body defining a compartment and a discharge opening; material within the compartment;

a sealing assembly that has a sealed state wherein the sealing assembly blocks communication of the material from the compartment to and through the discharge opening; and a first assembly for reconfiguring the sealing assembly to an operative state to establish a communication path from the compartment to and through the discharge opening, the first assembly comprising at least a first component that is movable guidingly relative to the body between: a) a storage position; and b) an operative position, the sealing assembly changeable from the sealed state into the operative state as an incident of the at least first component moving from the storage position into the operative position without the at least first component fully separating from the body, wherein the first assembly comprises a plurality of discrete components comprising blades that are each bent relative to the body at a location where the blades are locally thinned as the first component is moved from the storage position into the operative position, wherein the blades each has a length between where the blade is locally thinned and a free end, each blade configured so that the blade does not significantly deform between where the blade is locally thinned and the free end as an incident of the first component moving from the storage position into the operative position.

17. The container according to claim 16 wherein the blades each bends in a controlled manner at a defined edge.

18. A method of accessing a stored material, the method comprising the steps of:

providing a container as in claim 1;

with the sealing assembly in the sealed state, moving the first component from its storage position into its operative position and thereby changing the sealing assembly into the operative state; and with the sealing assembly in the operative state, causing material to be communicated from the compartment to and through the discharge opening.

* * * * *